US008262180B2

(12) United States Patent
Oshima et al.

(10) Patent No.: US 8,262,180 B2
(45) **Date of Patent: *Sep. 11, 2012**

(54) LIQUID JET APPARATUS AND PRINTING APPARATUS

(75) Inventors: Atsushi Oshima, Shiojiri (JP); Kunio Tabata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 333 days.

This patent is subject to a terminal disclaimer.

(21) Appl. No.: 11/780,379

(22) Filed: Jul. 19, 2007

(65) Prior Publication Data

US 2008/0018686 A1 Jan. 24, 2008

(30) Foreign Application Priority Data

Jul. 24, 2006 (JP) ..... 2006-200352
Jul. 13, 2007 (JP) ..... 2007-184438

(51) Int. Cl.
*B41J 29/38* (2006.01)

(52) U.S. Cl. ..... 347/9; 347/10

(58) Field of Classification Search ..... 347/10, 347/11, 14

See application file for complete search history.

(56) References Cited

U.S. PATENT DOCUMENTS 2,915,589 A 12/1959 Plant
4,254,439 A 3/1981 Fowler et al.
5,262,733 A 11/1993 Nakajima et al.
5,283,658 A 2/1994 Hayashi et al.
5,406,314 A 4/1995 Kuehnle
5,475,405 A 12/1995 Widder et al.
5,675,296 A 10/1997 Tomikawa
5,894,314 A * 4/1999 Tajika et al. ..... 347/14
6,133,844 A 10/2000 Ahne et al.
6,267,519 B1 * 7/2001 Otsuki et al. ..... 400/283
6,312,076 B1 11/2001 Taki et al.
6,312,096 B1 11/2001 Koitabashi et al.
6,320,605 B1 11/2001 Ikeda et al.
6,344,811 B1 2/2002 Melanson
6,364,443 B1 4/2002 Katano et al.

(Continued)

FOREIGN PATENT DOCUMENTS

EP 1594224 11/2005

(Continued)

OTHER PUBLICATIONS

U.S. Appl. No. 12/161,201, filed Jul. 17, 2008, Oshima et al.

(Continued)

*Primary Examiner* — Laura Martin

(74) *Attorney, Agent, or Firm* — Maschoff Gilmore & Israelsen

(57) ABSTRACT

A liquid jet apparatus includes a plurality of nozzles provided to a liquid jet head, an actuator provided corresponding to each of the nozzles, and drive unit that applies a drive signal to the actuator, wherein the drive unit includes drive waveform signal generation unit that generates a drive waveform signal providing a basis of a signal for controlling the operation of the actuator, modulator unit that pulse-modulates the drive waveform signal generated by the drive waveform signal generation unit, a digital power amplifier for power-amplifying the modulated signal, which is pulse-modulated by the modulator unit, a low-pass filter for smoothing the power-amplified and modulated signal power-amplified by the digital power amplifier and supplying the actuator with the power-amplified and modulated signal as the drive signal, and carrier frequency adjusting unit that adjusts a carrier frequency of the pulse modulation by the modulator unit in accordance with the number of the actuators to be driven.

4 Claims, 13 Drawing Sheets

U.S. PATENT DOCUMENTS

| | | | |
|---|---|---|---|
| 6,431,676 | B2 | 8/2002 | Asauchi et al. |
| 6,443,547 | B1 | 9/2002 | Takahashi et al. |
| 6,454,377 | B1 | 9/2002 | Ishizaki |
| 6,457,794 | B1 | 10/2002 | Tajika et al. |
| 6,474,762 | B2 | 11/2002 | Taki et al. |
| 6,502,930 | B1 | 1/2003 | Shimada et al. |
| 6,652,055 | B2 | 11/2003 | Oikawa |
| 6,776,469 | B2 | 8/2004 | Nozawa |
| 7,038,534 | B2 | 5/2006 | Hanzlik |
| 7,083,274 | B2 | 8/2006 | Morita |
| 7,111,755 | B2 | 9/2006 | Koyama et al. |
| 7,170,544 | B2 | 1/2007 | Horiuchi |
| 7,244,007 | B2 | 7/2007 | Ishizaki |
| 7,252,355 | B2 | 8/2007 | Umeda |
| 7,357,496 | B2 | 4/2008 | Silverbrook et al. |
| 7,384,128 | B2 | 6/2008 | Sheahan et al. |
| 7,571,989 | B2 | 8/2009 | Ishizaki |
| 7,717,530 | B2 | 5/2010 | Oshima |
| 7,731,317 | B2 | 6/2010 | Oshima |
| 7,748,812 | B2 | 7/2010 | Oshima |
| 2001/0040595 | A1 | 11/2001 | Taki et al. |
| 2002/0113832 | A1 | 8/2002 | Kanematsu et al. |
| 2002/0142733 | A1 | 10/2002 | Nishinakagawa |
| 2002/0163458 | A1 | 11/2002 | Jin |
| 2003/0112297 | A1 | 6/2003 | Hiratsuka et al. |
| 2003/0231179 | A1 | 12/2003 | Suzuki |
| 2004/0047477 | A1 | 3/2004 | Bank et al. |
| 2004/0119770 | A1 | 6/2004 | Tamura |
| 2004/0233241 | A1 | 11/2004 | Salacz |
| 2005/0057588 | A1 | 3/2005 | Umeda |
| 2005/0116977 | A1 | 6/2005 | Shinkawa et al. |
| 2005/0231179 | A1 | 10/2005 | Ishizaki |
| 2005/0248399 | A1 | 11/2005 | Kurokawa |
| 2006/0132231 | A1 | 6/2006 | Ishii et al. |
| 2006/0181342 | A1 | 8/2006 | Kanoh |
| 2007/0079710 | A1 | 4/2007 | Ishizaki |
| 2007/0120938 | A1 | 5/2007 | Fitzpatrick et al. |
| 2007/0165074 | A1* | 7/2007 | Ishizaki ..... 347/57 |
| 2008/0018683 | A1 | 1/2008 | Oshima et al. |
| 2008/0018685 | A1 | 1/2008 | Tabata et al. |
| 2008/0018687 | A1 | 1/2008 | Tabata et al. |
| 2008/0100652 | A1 | 5/2008 | Oshima et al. |
| 2008/0186350 | A1 | 8/2008 | Oshima et al. |
| 2008/0198191 | A1 | 8/2008 | Oshima |
| 2008/0218545 | A1 | 9/2008 | Oshima et al. |
| 2009/0033698 | A1 | 2/2009 | Suzuki et al. |
| 2009/0066739 | A1 | 3/2009 | Tabata et al. |
| 2009/0140780 | A1 | 6/2009 | Miyazaki et al. |
| 2009/0213152 | A1 | 8/2009 | Tabata et al. |
| 2009/0267979 | A1 | 10/2009 | Tabata et al. |
| 2009/0289980 | A1 | 11/2009 | Tabata et al. |
| 2009/0303271 | A1 | 12/2009 | Tabata et al. |
| 2010/0091059 | A1 | 4/2010 | Oshima et al. |
| 2010/0097419 | A1 | 4/2010 | Oshima |
| 2010/0188452 | A1 | 7/2010 | Oshima |
| 2010/0220133 | A1 | 9/2010 | Oshima et al. |
| 2011/0102486 | A1 | 5/2011 | Tabata et al. |
| 2011/0109674 | A1 | 5/2011 | Oshima et al. |

FOREIGN PATENT DOCUMENTS

| | | | |
|---|---|---|---|
| JP | 63-247059 | | 10/1988 |
| JP | 02-262705 | | 10/1990 |
| JP | 03-147446 | A | 6/1991 |
| JP | 05-077456 | | 3/1993 |
| JP | 05-199044 | | 8/1993 |
| JP | 09-234865 | A | 9/1997 |
| JP | 09-300618 | A | 11/1997 |
| JP | 09-308264 | | 11/1997 |
| JP | 10-081013 | | 3/1998 |
| JP | 10-210757 | A | 8/1998 |
| JP | 11-058733 | A | 3/1999 |
| JP | 11-204850 | | 7/1999 |
| JP | 11-204850 | A | 7/1999 |
| JP | 2000-117980 | A | 4/2000 |
| JP | 2000-238262 | | 9/2000 |
| JP | 2000-245162 | | 9/2000 |
| JP | 2001-121697 | | 5/2001 |
| JP | 2001-162794 | A | 6/2001 |
| JP | 2001-268922 | A | 9/2001 |
| JP | 2002-204595 | A | 7/2002 |
| JP | 2002-536903 | A | 10/2002 |
| JP | 2003-001824 | | 1/2003 |
| JP | 2003-237068 | | 8/2003 |
| JP | 2004-048886 | A | 2/2004 |
| JP | 2004-306434 | | 11/2004 |
| JP | 2004-306434 | A | 11/2004 |
| JP | 2005-035062 | | 2/2005 |
| JP | 2005-065068 | | 3/2005 |
| JP | 2005-075475 | | 3/2005 |
| JP | 2005-131928 | | 5/2005 |
| JP | 2005-322957 | | 11/2005 |
| JP | 2005-329710 | | 12/2005 |
| JP | 2005-349576 | A | 12/2005 |
| JP | 2006-025151 | | 1/2006 |
| JP | 2006-231882 | | 9/2006 |
| JP | 2006-256151 | | 9/2006 |
| JP | 2006-272907 | | 10/2006 |
| JP | 2006-272907 | A | 10/2006 |
| JP | 2006304490 | A * | 11/2006 |
| JP | 2007-069555 | | 3/2007 |
| JP | 2007-096364 | | 4/2007 |
| JP | 2007-144867 | | 6/2007 |
| JP | 2007-168172 | | 7/2007 |
| JP | 2007-190708 | | 8/2007 |
| JP | 2008-049698 | | 3/2008 |
| JP | 2008-049699 | | 3/2008 |
| JP | 2008-087467 | | 4/2008 |
| WO | 00/46919 | A2 | 8/2000 |

OTHER PUBLICATIONS

U.S. Appl. No. 12/637,412, filed Dec. 14, 2009, Oshima et al.
U.S. Appl. No. 11/780,301, mailed Jun. 27, 2008, Office Action.
U.S. Appl. No. 11/780,301, mailed Feb. 20, 2009, Final Office Action.
U.S. Appl. No. 11/780,301, mailed Jun. 16, 2009, Notice of Allowance.
U.S. Appl. No. 11/780,357, mailed Oct. 28, 2009, Office Action.
U.S. Appl. No. 11/780,390, mailed Apr. 8, 2009, Notice of Allowance.
U.S. Appl. No. 11/849,582, mailed May 28, 2008, Office Action.
U.S. Appl. No. 11/780,357, mailed Dec. 30, 2009, Final Office Action.
U.S. Appl. No. 11/923,448, mailed Nov. 27, 2009, Office Action.
U.S. Appl. No. 12/161,148, mailed Sep. 16, 2010, Final Office Action.
U.S. Appl. No. 12/161,201, mailed Sep. 28, 2010, Office Action.
U.S. Appl. No. 12/509,915, mailed Sep. 30, 2010, Office Action.
U.S. Appl. No. 12/637,412, mailed Aug. 23, 2010, Office Action.
U.S. Appl. No. 12/752,367, mailed Oct. 8, 2010, Office Action.
U.S. Appl. No. 11/780,357, mailed May 12, 2010, Final Office Action.
U.S. Appl. No. 11/849,582, mailed Apr. 19, 2010, Notice of Allowance.
U.S. Appl. No. 11/923,448, mailed Apr. 28, 2010, Final Office Action.
U.S. Appl. No. 12/351,472, mailed Jan. 4, 2010, Notice of Allowance.
U.S. Appl. No. 12/340,940, mailed Apr. 12, 2010, Notice of Allowance.
U.S. Appl. No. 12/161,148, mailed Mar. 30, 2010, Office Action.
Notice of Allowance dated Jun. 14, 2011 as received in related U.S. Appl. No. 12/637,412.
Office Action dated Jun. 14, 2011 as received in related U.S. Appl. No. 12/026,129.
Final Office Action dated Jun. 15, 2011 as received in related U.S. Appl. No. 12/027,175.
European Search Report dated Jan. 28, 2010 received in European Application No. EP07706915.1.
Office Action dated Mar. 4, 2011 as received in related U.S. Appl. No. 11/780,357.
Office Action dated Dec. 27, 2010 as received in related U.S. Appl. No. 12/026,129.

Office Action dated Dec. 27, 2010 as received in related U.S. Appl. No. 12/027,175.
Office Action dated Nov. 30, 2010 as received in related U.S. Appl. No. 12/689,926.
Notice of Allowance dated Apr. 5, 2010 as received in related U.S. Appl. No. 11/972,542.
Notice of Allowance dated Dec. 17, 2010 as received in related U.S. Appl. No. 12/498,296.
U.S. Office Action dated Oct. 11, 2011 as received in U.S. Appl. No. 12/624,206.
Japan Office Action dated Nov. 1, 2011 received in application No. 2007-181649.
United States Office Action dated Oct. 27, 2011 as received in U.S. Appl. No. 12/158,591.
United States Notice of Allowance dated Nov. 25, 2011 as received in U.S. Appl. No. 12/637,412.
US Office Action dated Jan. 9, 2012 as received in U.S. Appl. No. 12/389,525.
US Notice of Allowance dated Jan. 13, 2012 as received in U.S. Appl. No. 12/161,201.

* cited by examiner

LIQUID JET APPARATUS AND PRINTING APPARATUS

BACKGROUND

1. Technical Field

The present invention relates to a liquid jet apparatus and printing apparatus arranged to print predetermined letters and images by emitting microscopic droplets of liquids from a plurality of nozzles to form the microscopic particles (dots) thereof on a printing medium.

2. Related Art

An inkjet printer as one of such printing apparatuses, which is generally low-price and easily provides high quality color prints, has widely been spreading not only to offices but also to general users along with the widespread of personal computers or digital cameras.

Further, in recent inkjet printers, printing in fine tone is required. Tone denotes a state of density of each color included in a pixel expressed by a liquid dot, the size of the liquid dot corresponding to the color density of each pixel is called a tone grade, and the number of the tone grades that can be expressed by the liquid dot is called a tone number. The fine tone denotes that the tone number is large. In order for changing the tone grade, it is required to modify a drive pulse to an actuator provided to a liquid jet head. In the case in which a piezoelectric element is used as the actuator, since an amount of displacement (distortion) of the piezoelectric element (a diaphragm, to be precise) becomes large while a voltage value applied to the piezoelectric element becomes large, the tone grade of the liquid dot can be changed using this phenomenon.

Therefore, in JP-A-10-81013, it is arranged that a plurality of drive pulses with different wave heights is combined and joined to generate the drive signal, the drive signal is commonly output to the piezoelectric elements of the nozzles of the same color provided to the liquid jet head, a drive pulse corresponding to the tone grade of the liquid dot to be formed is selected for every nozzle out of the plurality of drive pulses, the selected drive pulses are supplied to the piezoelectric elements of the corresponding nozzles to emit droplets of the liquid different in weight, thereby achieving the required tone grade of the liquid dot.

The method of generating the drive signals (or the drive pulses) is described in FIG. 2 of JP-A-2004-306434. Specifically, the data is retrieved from a memory storing the data of the drive signal, the data is converted into analog data by a D/A converter, and the drive signal is supplied to the liquid jet head through a voltage amplifier and a current amplifier. The circuit configuration of the current amplifier is, as shown in FIG. 3 of JP-A-2004-306434, composed of push-pull connected transistors, and the drive signal is amplified by so called linear drive. However, in the current amplifier with such a configuration, the linear drive of the transistor itself is inefficient, a large-sized transistor is required as a measure against heating of the transistor itself, and moreover, a heat radiation plate for cooling the transistor is required, thus a disadvantage of growth in the circuit size arises, and among others, the size of the heat radiation plate for cooling constitutes a great barrier to design the layout.

In order for overcoming this disadvantage, in the inkjet printer described in JP-A-2005-35062, the drive signals are generated by controlling a reference voltage of a DC/DC converter. In this case, since the DC/DC converter with good efficiency is used, the heat radiation unit for cooling can be eliminated, and further, since a pulse width modulation (PWM) signal is used, a D/A converter can be configured with a simple low-pass filter, thus the circuit size can be made compact.

However, since the DC/DC converter is, in nature, designed to generate a constant voltage, in a head drive device of the inkjet printer described in JP-A-2005-35062 using the DC/DC converter described above, there is caused a problem that the waveform of the drive signal necessary for preferably ejecting an ink droplet from the inkjet head, such as rapid rising or falling waveform can hardly be obtained. Further, in a head drive device of the inkjet printer described in JP-A-2004-306434 for amplifying the current of an actuator drive signal with a push-pull transistor, there is caused a problem that the heat radiation plate for cooking is too large, to substantially complete the layout particularly in a line head printer having a large number of nozzles, namely the actuators.

SUMMARY

The present invention has an object of providing a liquid jet apparatus and a printing apparatus capable of achieving reduction of leakage of the carrier frequency component and high-speed switching when the number of the actuators to be driven is small, and reduction of the switching loss and large current driving when the number of the actuators is large, while making the rapid rising and falling of the drive signals to the actuators possible without requiring cooling unit such as a heat radiation plate for cooling.

A liquid jet apparatus according to the present invention is a liquid jet apparatus including a plurality of nozzles provided to a liquid jet head, an actuator provided corresponding to each of the nozzles, and drive unit that applies a drive signal to the actuator, wherein the drive unit includes drive waveform signal generation unit that generates a drive waveform signal providing a basis of a signal for controlling the operation of the actuator, modulator unit that pulse-modulates the drive waveform signal generated by the drive waveform signal generation unit, a digital power amplifier for power-amplifying the modulated signal, which is pulse-modulated by the modulator unit, a low-pass filter for smoothing the power-amplified and modulated signal power-amplified by the digital power amplifier and supplying the actuator with the power-amplified and modulated signal as the drive signal, and carrier frequency adjusting unit that adjusts a carrier frequency of the pulse modulation by the modulator unit in accordance with the number of the actuators to be driven.

According to the liquid jet apparatus of the present invention, the filter characteristic of the low-pass filter is set to be capable of sufficiently smoothing only the power amplified modified signal component, and the rapid rising and falling of the drive signal to the actuator become possible, and the drive signal can efficiently be power-amplified using the digital power amplifier with little power loss, cooling unit such as heat radiation plate for cooling can be eliminated.

Further, by adjusting the carrier frequency of the pulse modulation by the modulator in accordance with the number of the actuators to be driven, the reduction of the leakage of the carrier frequency component and the reduction of the switching loss become possible.

Further, it is preferable that the carrier frequency adjusting unit raises the carrier frequency of the pulse modulation in the case in which the number of the actuators to be driven is small, and lowers the carrier frequency of the pulse modulation in the case in which the number of the actuators to be driven is large.

According to the liquid jet apparatus of the invention described above, the leakage of the carrier frequency component in the case in which the number of actuators to be driven is small can be reduced and the switching loss in the case in which the number of actuators to be driven is large can be reduced.

Further, a liquid jet apparatus according to the present invention is a liquid jet apparatus including a plurality of nozzles provided to a liquid jet head, an actuator provided corresponding to each of the nozzles, and drive unit that applies a drive signal to the actuator, wherein the drive unit includes drive waveform signal generation unit that generates a drive waveform signal providing a basis of a signal for controlling the operation of the actuator, modulator unit that pulse-modulates the drive waveform signal generated by the drive waveform signal generation unit, a digital power amplifier having a plurality of transistors connected in parallel to a power supply and for power-amplifying the modulated signal pulse-modulated by the modulator unit, a low-pass filter for smoothing the power-amplified and modulated signal power-amplified by the digital power amplifier and supplying the actuator with the power-amplified and modulated signal as the drive signal, and number of transistors adjusting unit that adjusts the number of the drive transistors of the digital power amplifier in accordance with the number of the actuators to be driven.

According to the liquid jet apparatus of the present invention, the filter characteristic of the low-pass filter is set to be capable of sufficiently smoothing only the power amplified modified signal component, and the rapid rising and falling of the drive signal to the actuator become possible, and the drive signal can efficiently be power-amplified using the digital power amplifier with little power loss, cooling unit such as heat radiation plate for cooling can be eliminated.

Further, by adjusting the number of the drive transistors of the digital power amplifier in accordance with the number of the actuators to be driven, the high-speed switching and the large current driving become possible.

Further it is preferable that the number of transistors adjusting unit decreases the number of the drive transistors in the case in which the number of the actuators to be driven is small, and increases the number of the drive transistors in the case in which the number of the actuators to be driven is large.

According to the liquid jet apparatus of the invention described above, the total capacitance of the transistors in the case in which the number of the actuators to be driven is small is reduced to make the high-speed switching possible, and the drive current in the case in which the number of the actuators to be driven is large is distributed to a plurality of transistors, thus the large current driving becomes possible.

Further, the printing apparatus of the invention is preferably a printing apparatus provided with the liquid jet apparatus described above. According to the printing apparatus of the present invention, the filter characteristic of the low-pass filter is set to be capable of sufficiently smoothing only the power amplified modified signal component, and the rapid rising and falling of the drive signal to the actuator become possible, and the drive signal can efficiently be power-amplified using the digital power amplifier with little power loss, cooling unit such as heat radiation plate for cooling can be eliminated, thus the low power consumption can be achieved with reduced power loss, a plurality of liquid jet head can be disposed with good efficiency, thus the downsizing of the printing apparatus can be performed.

BRIEF DESCRIPTION OF THE DRAWINGS

FIG. 1 shows schematic configuration views showing an embodiment of a line head printing apparatus applying the liquid jet apparatus according to the present invention, wherein

DESCRIPTION OF EXEMPLARY EMBODIMENTS

An embodiment will be explained with reference to the drawings using a printing apparatus for printing letters and images on a print medium by emitting a liquid jet, as an example of the present invention.

Figure 1A:
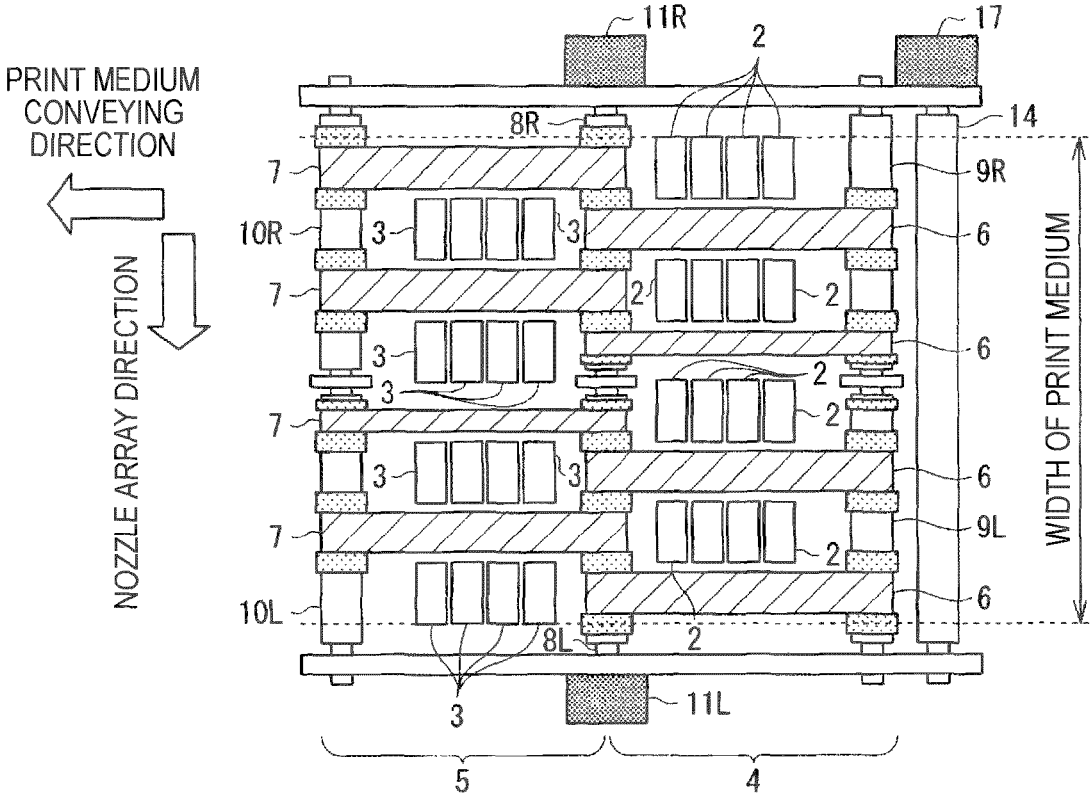
FIG. 1A is a plan view thereof.
Figure 1B:
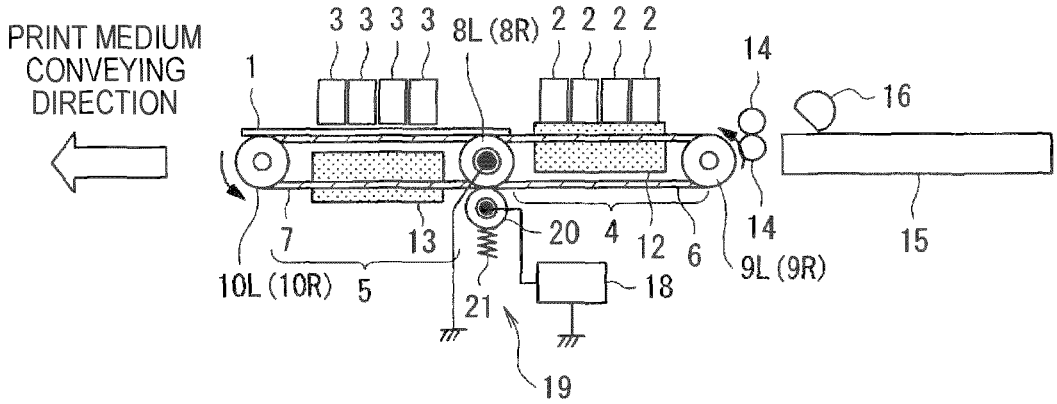
FIG. 1B is a front view thereof.

FIGS. 1A and 1B are schematic configuration views of the printing apparatus according to the present embodiment, wherein FIG. 1A is a plan view thereof, and FIG. 1B is a front view thereof. In FIG. 1, in the line head printing apparatus, a print medium 1 is conveyed from upper right to lower left of the drawing along the arrow direction, and is printed in a print area in the middle of the conveying path. It should be noted that the liquid jet head of the present embodiment is not disposed integrally in one place, but is disposed separately in two places.

The reference numeral 2 in the drawing denotes a first liquid jet head disposed on the upstream side in the conveying direction of the print medium 1, the reference numeral 3 denotes a second liquid jet head disposed downstream side in the conveying direction thereof, a first conveying section 4 for conveying the print medium 1 is disposed below the first liquid jet head 2, and a second conveying section 5 is disposed below the second liquid jet head 3. The first conveying section 4 is composed of four first conveying belts 6 disposed with predetermined intervals in the direction (hereinafter also referred to as a nozzle array direction) traversing the conveying direction of the print medium 1, the second conveying section 5 is similarly composed of four second conveying belts 7 disposed with predetermined intervals in the direction (the nozzle array direction) traversing the conveying direction of the print medium 1.

The four first conveying belts 6 and the similar four second conveying belts 7 are disposed alternately adjacent to each other. In the present embodiment, out of the conveying belts 6, 7, the two first and second conveying belts 6, 7 in the right side in the nozzle array direction are distinguished form the two first and second conveying belts 6, 7 in the left side in the nozzle array direction. In other words, an overlapping portion of the two of the first and second conveying belts 6, 7 in the right side in the nozzle array direction is provided with a right side drive roller 8R, an overlapping portion of the two of the first and second conveying belts 6, 7 in the left side in the nozzle array direction is provided with a left side drive roller 8L, a right side first driven roller 9R and left side first driven roller 9L are disposed on the upstream side thereof, and a right side second driven roller 10R and left side second driven roller 10L are disposed on the downstream side thereof. Although these rollers may seem a series of rollers, actually they are decoupled at the center portion of FIG. 1A.

Further, the two first conveying belts 6 in the right side in the nozzle array direction is wound around the right side drive roller 8R and the right side first driven roller 9R, the two first conveying belts 6 in the left side in the nozzle array direction is wound around the left side drive roller 8L and the left side first driven roller 9L, the two second conveying belts 7 in the right side in the nozzle array direction is wound around the right side drive roller 8R and the right side second driven roller 10R, the two second conveying belts 7 in the left side in the nozzle array direction is wound around the left side drive roller 8L and the left side second driven roller 10L, and further, a right side electric motor 11R is connected to the right side drive roller 8R, and a left side electric motor 11L is connected to the left side drive roller 8L. Therefore, when the right side electric motor 11R rotationally drives the right side drive roller 8R, the first conveying section 4 composed of the two first conveying belts 6 in the right side in the nozzle array direction and similarly the second conveying section 5 composed of the two second conveying belts 7 in the right side in the nozzle array direction moves in sync with each other and at the same speed, while the left side electric motor 11L rotationally drives the left side drive roller 8L, the first conveying section 4 composed of the two first conveying belts 6 in the left side in the nozzle array direction and similarly the second conveying section 5 composed of the two second conveying belts 7 in the left side in the nozzle array direction moves in sync with each other and at the same speed.

It should be noted that by arranging the rotational speeds of the right side electric motor 11R and the left side electric motor 11L to be different from each other, the conveying speeds in the left and right in the nozzle direction can be set different from each other, specifically, by arranging the rotational speed of the right side electric motor 11R higher than the rotational speed of the left side electric motor 11L, the conveying speed in the right side in the nozzle array direction can be made higher than that in the left side, and by arranging the rotational speed of the left side electric motor 11L higher than the rotational speed of the right side electric motor 11R, the conveying speed in the left side in the nozzle array direction can be made higher than that in the right side.

The first liquid jet head 2 and the second liquid jet head 3 are disposed by a unit of colors, yellow (Y), magenta (M), cyan (C), and black (K) shifted in the conveying direction of the print medium 1. The liquid jet heads 2, 3 are supplied with liquids from liquid tanks of respective colors not shown via liquid supply tubes. Each of the liquid jet heads 2, 3 is provided with a plurality of nozzles formed in the direction (namely, the nozzle array) traversing the conveying direction of the print medium 1, and by emitting a necessary amount of the liquid jet from the respective nozzles simultaneously to the necessary positions, microscopic liquid dots are formed on the print medium 1. By performing the process described above by the unit of the colors, one-pass print can be achieved only by making the print medium 1 conveyed by the first and second conveying sections 4, 5 pass therethrough once. In other words, the area in which the liquid jet heads 2, 3 are disposed corresponds to the print area.

As a method of emitting liquid jets from each of the nozzles of the liquid jet heads, an electrostatic method, a piezoelectric method, and a film boiling jet method and so on can be cited. In the electrostatic method, when a drive signal is provided to an electrostatic gap as an actuator, a diaphragm in a cavity is displaced to cause pressure variation in the cavity, and the liquid jet is emitted from the nozzle in accordance with the pressure variation. In the piezoelectric method, when a drive signal is provided to a piezoelectric element as an actuator, a diaphragm in a cavity is displaced to cause pressure variation in the cavity, and the liquid jet is emitted from the nozzle in accordance with the pressure variation. In the film boiling jet method, a microscopic heater is provided in the cavity, and is instantaneously heated to be at a temperature higher than 300° C. to make the liquid become the film boiling state to generate a bubble, thus causing the pressure variation making the liquid jet be emitted from the nozzle. The present invention can apply either liquid jet methods, and among others, the invention is particularly preferable for the piezoelectric element capable of adjusting an amount of the liquid jet by controlling the wave height or gradient of increase or decrease in the voltage of the drive signal.

The liquid jet emission nozzles of the first liquid jet head 2 are only provided between the four first conveying belts 6 of the first conveying section 4, the liquid jet emission nozzles of the second liquid jet head 3 are only provided between the four second conveying belts 7 of the second conveying section 5. Although this is for cleaning each of the liquid jet heads 2, 3 with a cleaning section described later, in this case, the entire surface is not printed by the one-pass printing if either one of the liquid jet heads is used. Therefore, the first liquid jet head 2 and the second liquid jet head 3 are disposed shifted in the conveying direction of the print head 1 in order for compensating for each other's unprintable areas.

What is disposed below the first liquid jet head 2 is a first cleaning cap 12 for cleaning the first liquid jet head 2, and what is disposed below the second liquid jet head 3 is a second cleaning cap 13 for cleaning the second liquid jet head 3. Each of the cleaning caps 12, 13 is formed to have a size allowing the cleaning caps to pass through between the four first conveying belts 6 of the first conveying section 4 and between the four second conveying belts 7 of the second conveying section 5. Each of the cleaning caps 12, 13 is composed of a cap body having a rectangular shape with a bottom, covering the nozzles provided to the lower surface, namely a nozzle surface of the liquid jet head 2, 3, and capable of adhering the nozzle surface, a liquid absorbing body disposed at the bottom, a peristaltic pump connected to the bottom of the cap body, and an elevating device for moving the cap body up and down. Then, the cap body is moved up by the elevating device to be adhered to the nozzle surface of the liquid jet head 2, 3. By causing the negative pressure in the cap body using the peristaltic pump in the present state, the liquid and bubbles are suctioned from the nozzles opened on the nozzle surface of the liquid jet head 2, 3, thus the cleaning of the liquid jet head 2, 3 can be performed. After the cleaning is completed, each of the cleaning caps 12, 13 is moved down.

On the upstream side of the first driven rollers 9R, 9L, there provided a pair of gate rollers 14 for adjusting the feed timing of the print medium 1 from a feeder section 15 and at the same time correcting the skew of the print medium 1. The skew denotes a turn of the print medium 1 with respect to the conveying direction. Further, above the feeder section 15, there is provided a pickup roller 16 for feeding the print medium 1. It should be noted that the reference numeral 17 in the drawing denotes a gate roller motor for driving the gate rollers 14.

A belt charging device 19 is disposed below the drive rollers 8R, 8L. The belt charging device 19 is composed of a charging roller 20 having a contact with the first conveying belts 6 and the second conveying belts 7 via the drive rollers 8R, 8L, a spring 21 for pressing the charging roller 20 against the first conveying belts 6 and the second conveying belts 7, and a power supply 18 for providing charge to the charging roller 20, and charges the first conveying belts 6 and the second conveying belts 7 by providing them with the charge. Since the belts are generally made of a moderate or high resistivity material or an insulating material, when the they are charged by the belt charging device 19, the charge applied on the surface thereof causes the print medium 1 made similarly of a high resistivity material or an insulating material the dielectric polarization, and the print medium 1 can be absorbed to the belt by the electrostatic force caused between the charge generated by the dielectric polarization and the charge on the surface of the belt. It should be noted that as the belt charging device 19, a corotron for showering the charges can also be used.

Therefore, according to the present printing apparatus, when the surfaces of the first conveying belts 6 and the second conveying belts 7 are charged by the belt charging device 19, the print medium 1 is fed from the gate roller 14 in that state, and the print medium 1 is pressed against the first conveying belts 6 by a sheet pressing roller composed of a spur or a roller not shown, the print medium 1 is absorbed by the surfaces of the first conveying belts 6 under the action of dielectric polarization. In this state, when the electric motors 11R, 11L rotationally drive the drive rollers 8R, 8L, the rotational drive force is transmitted to the first driven rollers 9R, 9L via the first conveying belts 6.

Thus, the first conveying belts 6 is moved to the downstream side of the conveying direction while absorbing the print medium 1, printing is performed by emitting liquid jets from the nozzles formed on the first liquid jet head 2 while moving the print medium 1 to below the first liquid jet head 2. When the printing by the first liquid jet head 2 is completed, the print medium 1 is moved downstream side of the conveying direction to be switched to the second conveying belts 7 of the second conveying section 5. As described above, since the second conveying belts 7 are also provided with the charge on the surface thereof by the belt charging device 19, the print medium 1 is absorbed by the surfaces of the second conveying belts 7 under the action of the dielectric polarization.

In the present state, the second conveying belts 7 is moved to the downstream side of the conveying direction, printing is performed by emitting liquid jets from the nozzles formed on the second liquid jet head while moving the print medium 1 to below the second liquid jet head 3. After the printing by the second liquid jet head is completed, the print medium 1 is moved further to the downstream side of the conveying direction, the print medium 1 is ejected to a catch tray while separating it from the surfaces of the second conveying belts 7 by a separating device not shown in the drawings.

Further, when the cleaning of the first and second liquid jet heads 2, 3 becomes necessary, as described above, the first and second cleaning caps 12, 13 are raised to be adhered to the nozzle surfaces of the first and second liquid jet heads 2, 3, the cleaning is performed by applying negative pressure to the inside of the caps at that state to suction ink droplets and bubbles from the nozzles of the first and second liquid jet heads 2, 3, and after then, the first and second cleaning caps 12, 13 are moved down.

Figure 2:
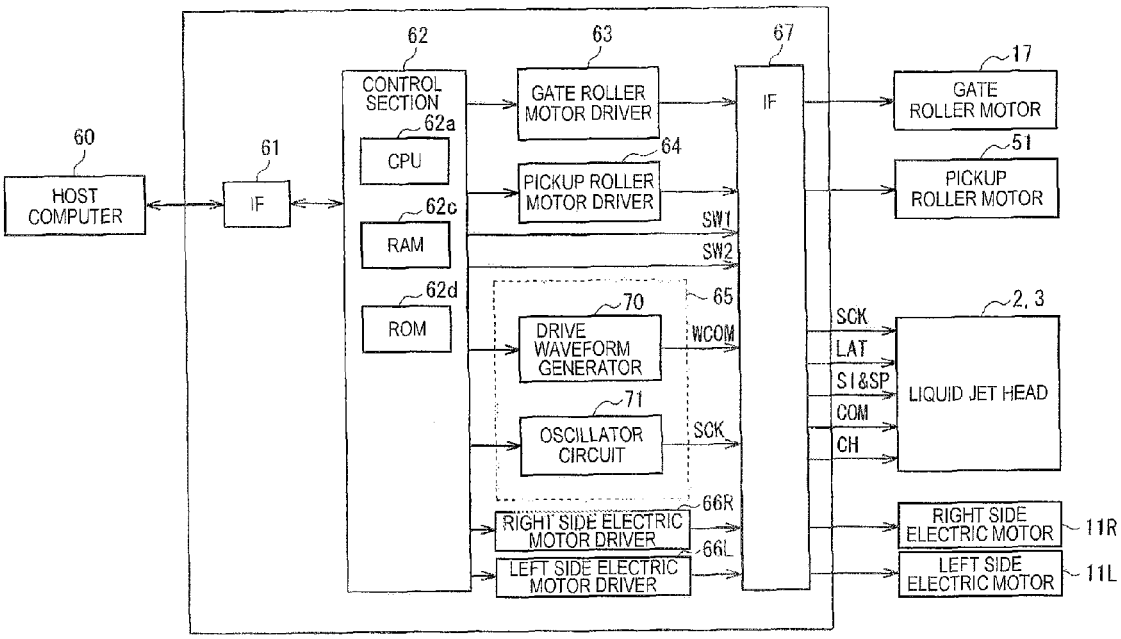
FIG. 2 is a block diagram of a control device of the printing apparatus shown in FIG. 1.

Inside the printing apparatus, there is provided a control device for controlling the device itself. The control device is, as shown in FIG. 2, for controlling the printing apparatus, the feeder device, and soon base on print data input from a host computer 60 such as a personal computer or a digital camera, thereby performing the print process on the print medium. Further, the control device is configured including an input interface section 61 for receiving print data input from the host computer 60, a control section 62 formed of a microcomputer for performing the print process based on the print data input from the input interface section 61, a gate roller motor driver 63 for controlling driving the gate roller motor 17, a pickup roller motor driver 64 for controlling driving a pickup roller motor 51 for driving the pickup roller 16, a head driver 65 for controlling driving the liquid jet heads 2, 3, a right side electric motor driver 66R for controlling driving the right side electric motor 11R, a left side electric motor driver 66L for controlling driving the left side electric motor 11L, and an interface 67 for converting the output signals of the drivers 63 through 65, 66R, 66L into drive signals used in the gate roller motor 17, the pickup roller motor 51, the liquid jet heads 2, 3, the right side electric motor 11R, and the left side electric motor 11L outside thereof.

The control section 62 is provided with a central processing unit (CPU) 62*a* for performing a various processes such as the print process, a random access memory (RAM) 62*c* for temporarily stores the print data input via the input interface 61 and various kinds of data used in performing the print process of the print data, and for temporarily developing an application program such as for the print process, and a read-only memory (ROM) 62*d* formed of a nonvolatile semiconductor memory and for storing the control program executed by the CPU 62*a* and so on. When the control section 62 receives the print data (image data) from the host computer 60 via the interface section 61, the CPU 62*a* performs a predetermined process on the print data to output printing data (drive pulse selection data SI&SP) regarding which nozzle emits the liquid jet or how much liquid jet is emitted, and further outputs the control signals to the respective drivers 63 through 65, 66R, and 66L base on the printing data and the input data from the various sensors. When the control signals are output from the respective drivers 63 through 65, 66R, and 66L, the control signals are converted by the interface section 67 into the drive signals, the actuators corresponding to a plurality of nozzles of the liquid jet heads, the gate roller motor 17, the pickup roller motor 51, the right side electric motor 11R, and the left side electric motor 11L respectively operate, thus the feeding and conveying the print medium 1, posture control of the print medium 1, and the print process to the print medium 1 are performed. Further, the control section 62 outputs switch drive signals swp1, swn1, swp2, and swn2 towards a digital power amplifier of a drive signal output circuit described later disposed inside the interface section 67 to switch on and off a plurality of MOSFET in the digital power amplifier. It should be noted that the elements inside the control section 62 are electrically connected to each other via a bus not shown in the drawings.

Further, in order for writing the waveform forming data DATA for forming the drive signal described later in a waveform memory 701, the control section 62 outputs a write enable signal DEN, a write clock signal WCLK, and write address data A0 through A3 to write the 16 bit waveform forming data DATA into the waveform memory 701, and further, outputs the read address data A0 through A3 for reading the waveform forming data DATA stored in the waveform memory 701, a first clock signal ACLK for setting the timing for latching the waveform forming data DATA retrieved from the waveform memory 701, a second clock signal BCLK for setting the timing for adding the latched waveform data, and a clear signal CLER for clearing the latched data to the head driver 65.

Figure 3:
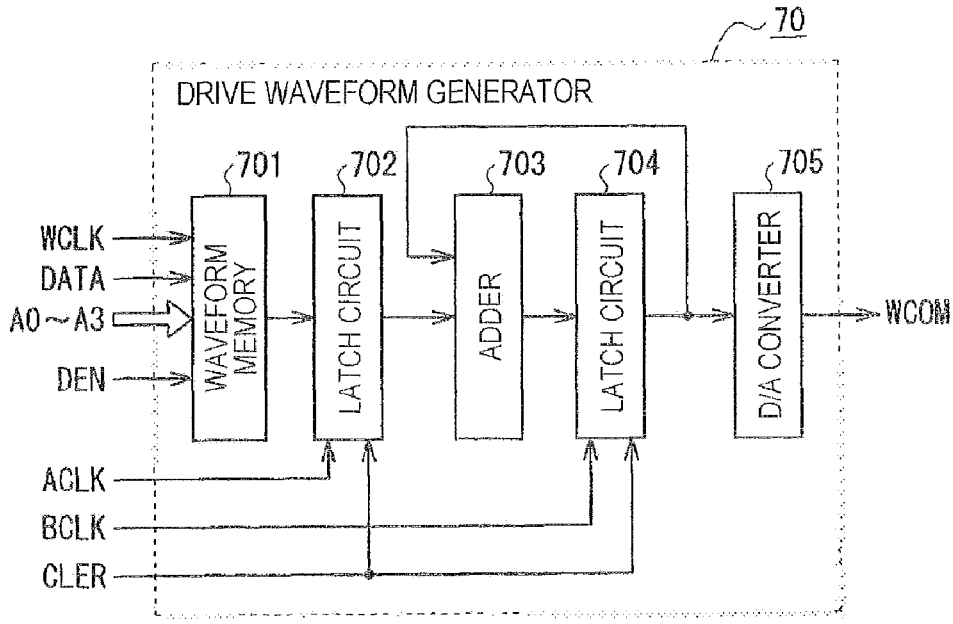
FIG. 3 is a block configuration diagram of the drive waveform signal generation circuit shown in FIG. 2.

The head driver 65 is provided with a drive waveform generator 70 for forming drive waveform signal WCOM and an oscillator circuit 71 for outputting a clock signal SCK. The drive waveform generator 70 is provided, as shown in FIG. 3, with the waveform memory 701 for storing the waveform forming data DATA for forming the drive waveform signal input from the control section 62 in the storage element corresponding to a predetermined address, a latch circuit 702 for latching the waveform forming data DATA retrieved from the waveform memory 701 in accordance with the first clock signal ACLK described above, an adder 703 for adding the output of the latch circuit 702 with the waveform generation data WDATA output from a latch circuit 704 described later, the latch circuit 704 for latching the added output of the adder 703 in accordance with the second clock signal BCLK, and a D/A converter 705 for converting the waveform generation data WDATA output from the latch circuit 704 into an analog signal. In this case, the clear signal CLER output from the control section 62 is input to the latch circuits 702, 704, and when the clear signal CLER is turned to be the off state, the latched data is cleared.

Figure 4:
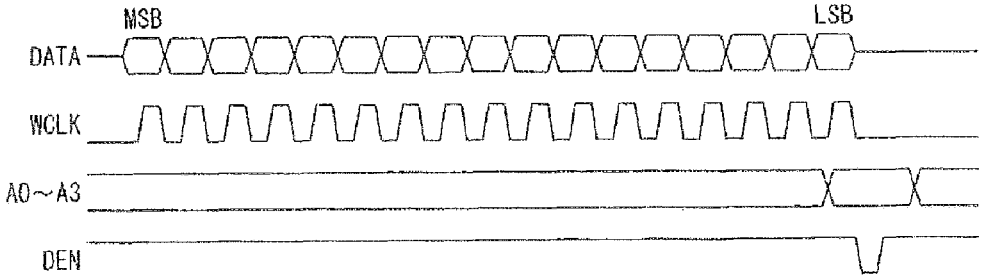
FIG. 4 is an explanatory diagram of the waveform memory shown in FIG. 3.

The waveform memory 701 is provided, as shown in FIG. 4, with a several bits of memory elements arranged in each designated address, and the waveform data DATA is stored together with the address A0 through A3. Specifically, the waveform data DATA is input in accordance with the clock signal WCLK with respect to the address A0 through A3 designated by the control section 62, and the waveform data DATA is stored in the memory elements in response to input of the write enable signal DEN.

Subsequently, the principle of generating the drive waveform signal by the drive waveform generator 70 will be explained. Firstly, in the address A0, there is written the waveform data of zero as an amount of voltage variation per unit time period. Similarly, the waveform data of +ΔV1 is written in the address A1, the waveform data of −ΔV2 is written in the address A2, and the waveform data of +ΔV3 is written in the address A3, respectively. Further, the stored data in the latch circuits 702, 704 is cleared by the clear signal CLER. Further, the drive waveform signal WCOM is raised to an intermediate voltage potential (offset) by the waveform data.

Figure 5:
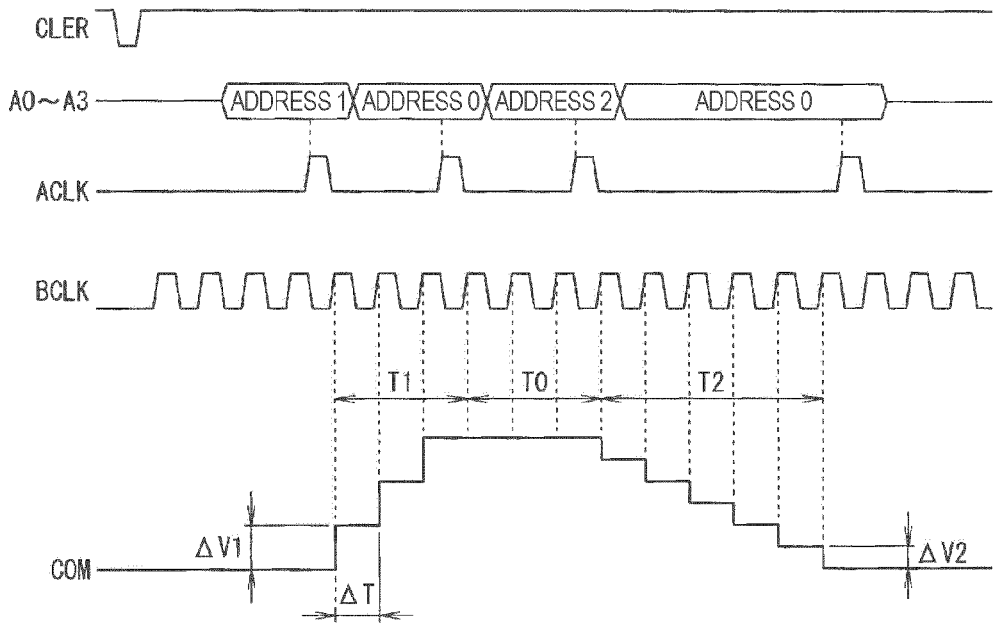
FIG. 5 is an explanatory diagram of generation of the drive waveform signal.

In the present state, when the waveform data in the address A1 is retrieved, as shown in FIG. 5, for example, and the first clock signal ACLK is input, the digital data of +ΔV1 is stored in the latch circuit 702. The stored digital data of +ΔV1 is input to the latch circuit 704 via the adder 703, and in the latch circuit 704, the output of the adder 703 is stored in sync with the rising of the second clock BCLK. Since the output of the latch circuit 704 is also input to the adder 703, the output of the latch circuit 704, namely the drive signal COM is added with +ΔV1 with every rising timing of the second clock BCLK. In the present example, the waveform data in the address of A1 is retrieved for a time interval of T1, and as a result, the digital data of +ΔV1 is added to be three times as large as +ΔV1.

Subsequently, when the waveform data in the address A0 is retrieved, and in addition, the first clock ACLK is input, the digital data stored in the latch circuit 702 is switched to zero. Although this digital data of zero is, similarly to the case described above, added through the adder 703 with the rising timing of the second clock signal BCLK, since the digital data is zero, the previous value is actually maintained. In the present example, the drive signal COM is maintained at a constant value for the time period of T0.

Subsequently, when the waveform data in the address A2 is retrieved, and in addition, the first clock ACLK is input, the digital data stored in the latch circuit 702 is switched to −ΔV2. Although the digital data of −ΔV2 is, similarly to the case described above, added through the adder 703 with the rising timing of the second clock signal BCLK, since the digital data is −ΔV2, the drive signal COM is actually subtracted by −ΔV2 in accordance with the second clock signal. In the present embodiment, the digital data is subtracted for the time period of T2 until the digital data becomes 6 times as large as −ΔV2.

Figure 6:
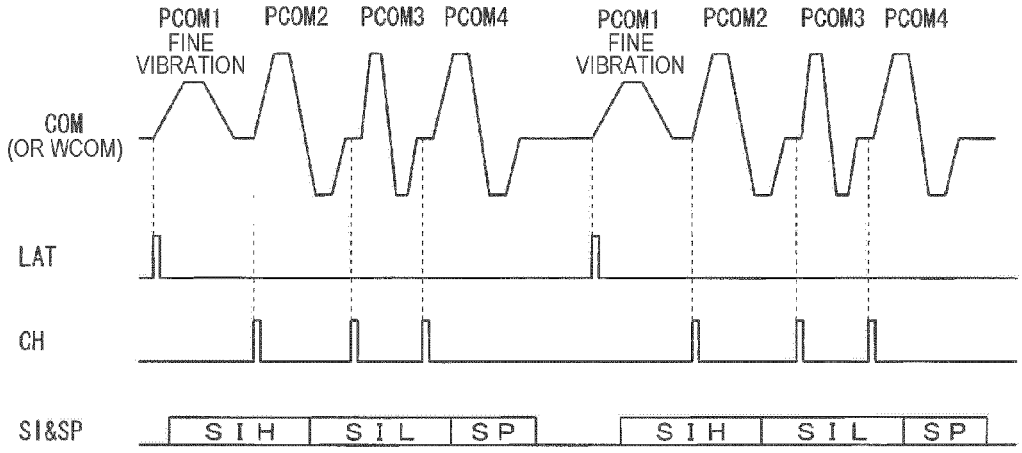
FIG. 6 is an explanatory diagram of the drive waveform signal or the drive signal connected in a time-series manner.
Figure 7:
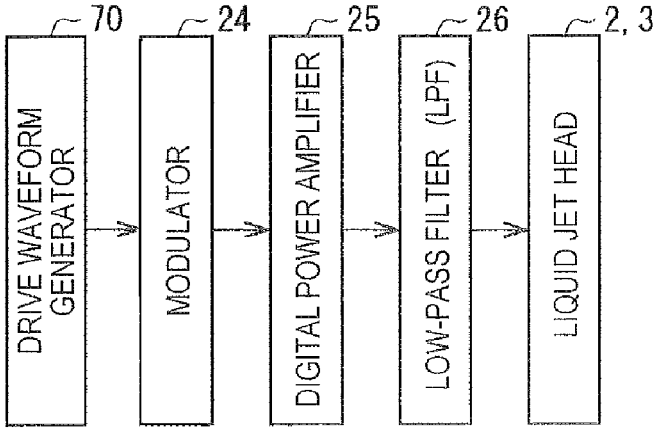
FIG. 7 is a block configuration diagram of a drive signal output circuit.

By performing the analog conversion by the D/A converter 705 on the digital signal thus generated, the drive waveform signal WCOM as shown in FIG. 6 can be obtained. By performing the power amplification by the drive signal output circuit shown in FIG. 7 on the above signal, and supplying it to the liquid jet heads 2, 3 as the drive signal COM, it becomes possible to drive the actuator provided to each of the nozzles, thus the liquid jet can be emitted from each of the nozzles. The drive signal output circuit is configured including a modulator 24 for performing the pulse width modulation on the drive waveform signal WCOM generated by the drive waveform generator 70, a digital power amplifier 25 for performing the power amplification on the modulated (PWM) signal on which the pulse width modulation is performed by the modulator 24, and a low-pass filter 26 for smoothing the modulated signal amplified by the digital power amplifier 25.

The rising portion of the drive signal COM corresponds to the stage of expanding the capacity of the cavity (pressure chamber) communicating the nozzle to pull in the liquid (it can be said that the meniscus is pulled in considering the emission surface of the liquid), and the falling portion of the drive signal COM corresponding to the stage of reducing the capacity of the cavity to push out the liquid (it can be said that the meniscus is pushed out considering the emission surface of the liquid), as the result of pushing out the liquid, the liquid jet is emitted from the nozzle. The series of waveform signals from pulling in the liquid to pushing out the liquid according to needs are assumed to form the drive pulse, and the drive signal COM is assumed to be formed by linking a plurality of drive pulses. Incidentally, the waveform of the drive signal COM or of the drive waveform signal WCOM can be, as easily inferred from the above description, adjusted by the waveform data 0, +ΔV1, −ΔV2, and +ΔV3 stored in the addresses A0 through A3, the first clock signal ACLK, the second clock signal BCLK. Further, although the first clock signal ACLK is called a clock signal for the sake of convenience, actually, the output timing of the signal can freely be adjusted by arithmetic processing described later.

By variously changing the gradient of increase and decrease in voltage and the height of the drive signal COM formed of trapezoidal voltage waves, the pull-in amount and the pull-in speed of the liquid, and the push-out amount and the push-out speed of the liquid can be changed, thus the amount of liquid jet can be changed to obtain a different size of the liquid dot. Therefore, as shown in FIG. 6, in the case in which a plurality of drive pulses are sequentially joined to form the drive signal COM, it is possible that the single drive pulse is selected from such drive pulses to supply the actuator to emit the liquid jet, or a plurality of drive pulses is selected and supplied to the actuator to emit the liquid jet a number of times, thus the liquid dots with various sizes can be obtained. In other words, when a number of liquid droplets land on the same position while the liquid is not dried, it brings substantially the same result as emitting a larger droplet of the liquid, thus the size of the liquid dot can be enlarged. By combination of such technologies, the fine tone printing can be achieved. It should be noted that the drive pulse shown in the left end of FIG. 6 is only for pulling in the liquid but not for pushing out the liquid. This is called a fine vibration, and is used for preventing the nozzle from drying without emitting the liquid jet.

As a result of the above, the liquid jet head 2, 3 are provided with the drive signal COM generated by the drive signal output circuit, the drive pulse selection data SI&SP for selecting the nozzle emitting the liquid jet and determining the connection timing of the actuator to the drive signal COM based on the print data, the latch signal LAT and a channel signal CH for connecting the drive signal COM and the actuator of the liquid jet head 2, 3 based on the drive pulse selection data SI&SP after the nozzle selection data is input to all of the nozzles, and the clock signal SCK for transmitting the drive pulse selection data SI&SP to the liquid jet head 2, 3 as serial signals. It should be noted that hereinafter, in the case in which a plurality of drive signals COM are joined and output in a time-series manner, a single drive signal COM is described as the drive pulse PCOM, and the whole signal obtained by joining the drive pulse PCOM in a time-series manner is described as the drive signal COM.

Figure 8:
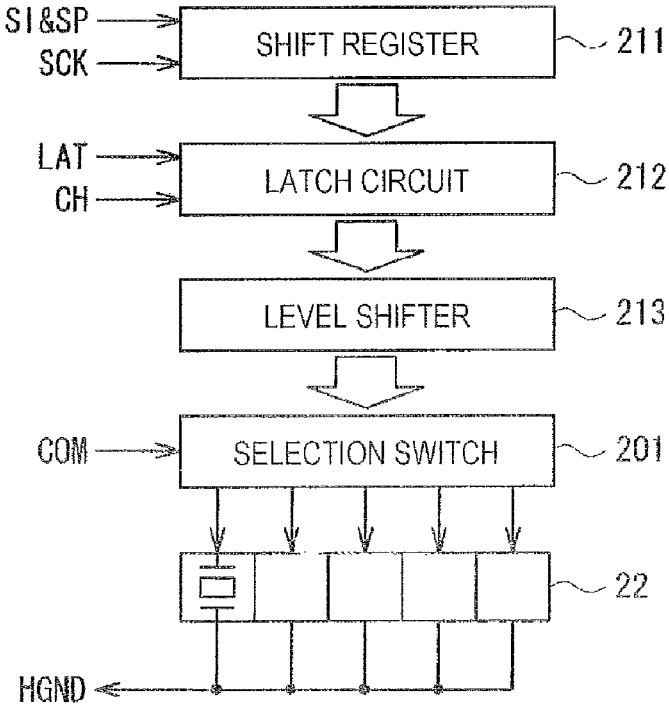
FIG. 8 is a block diagram of a selection section for connecting the drive signal to an actuator.

Subsequently, the configuration of connecting the drive signals COM output from the drive signal output circuit to the actuator will be explained. FIG. 8 is a block diagram of the selection section for connecting the drive signals COM to the actuators 22 such as the piezoelectric element. The selection section is composed of a shift register 211 for storing the drive pulse selection data SI&SP for designating the actuator 22 such as a piezoelectric element corresponding to the nozzle from which the liquid jet is to be emitted, a latch circuit 212 for temporarily storing the data of the shift register 211, a level shifter 213 for performing level conversion on the output of the latch circuit 212, and a selection switch 201 for connecting the drive signal COM to the actuator 22 such as a piezoelectric element in accordance with the output of the level shifter.

The drive pulse selection data SI&SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the input latch signal LAT after the drive pulse selection data SI&SP corresponding to the number of the nozzles is stored in the register 211. The signals stored in the latch circuit 212 are converted into the voltage levels capable of switching on and off the selection switch 201 on the subsequent stage by the level shifter 213. This is because the drive signal COM has a high voltage compared to the output voltage of the latch circuit 212, and the operating voltage range of the selection switch 201 is also set higher accordingly. Therefore, the actuator 22 such as piezoelectric element the selection switch 201 of which is closed by the level shifter 213 is connected to the drive signal COM with the connection timing of the drive pulse selection data SI&SP. Further, after the drive pulse selection data SI&SP of the shift register 211 is stored in the latch circuit 212, the subsequent drive pulse selection data SI&SP is input to the shift register 211, and the stored data of the latch circuit 212 is sequentially updated with the liquid jet emission timing. It should be noted that the reference HGND in the drawings denotes the ground terminal for the actuator 22 such as the piezoelectric element. Further, according to the selection switch 201, even after the actuator 22 such as the piezoelectric element is separated from the drive signal COM, the input voltage of the actuator 22 is maintained at the voltage immediately before it is separated.

Figure 9:
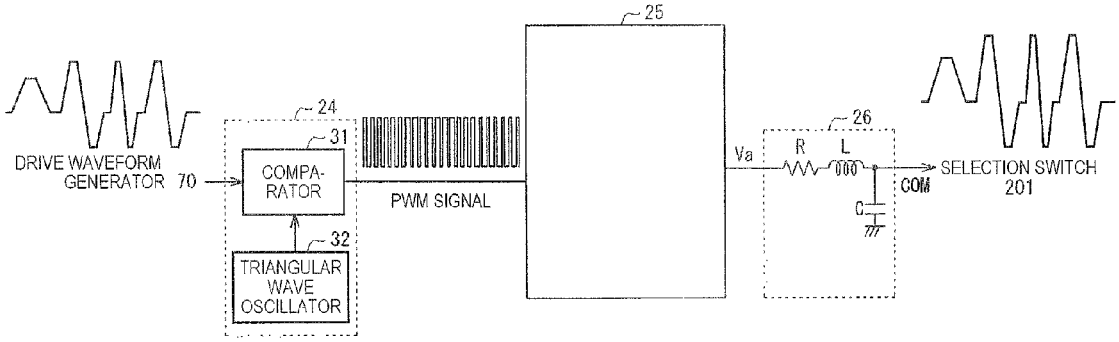
FIG. 9 is a block diagram showing details of the modulation circuit, the digital power amplifier, and the low-pass filter of the drive signal output circuit shown in FIG. 7.
Figure 10:
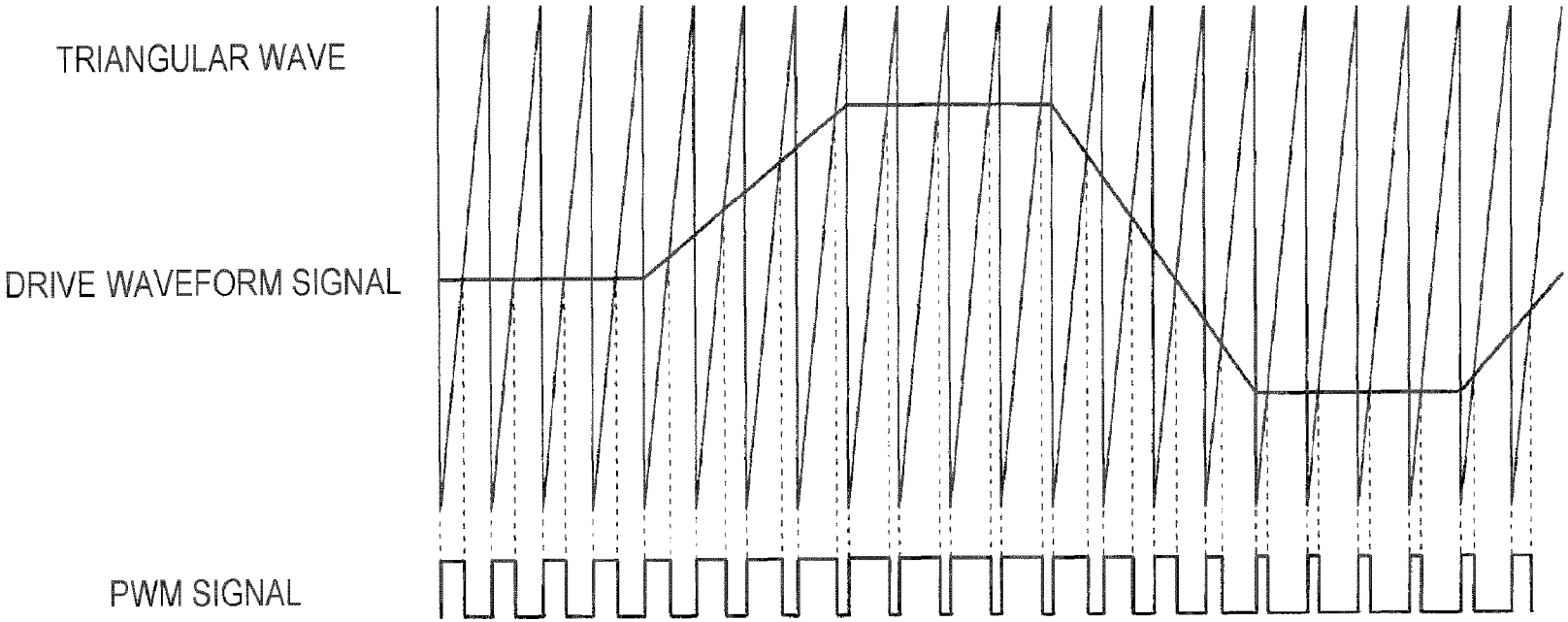
FIG. 10 is an explanatory diagram of the operation of the modulator shown in FIG. 9.

FIG. 9 shows a specific configuration from the modulator 24 of the drive signal output circuit described above to the low-pass filter 26. As the modulator 24 for performing the pulse width modulating on the drive waveform signal WCOM, a typical pulse width modulation (PWM) circuit is used. The modulator 24 is composed of a well-known triangular wave oscillator 32, and a comparator 31 for comparing the triangular wave output from the triangular wave oscillator 32 with the drive waveform signal WCOM. According to the modulator 24, as shown in FIG. 10, the modulated (PWM) signal, which is set to HIGH level when the drive waveform signal WCOM exceeds the triangular wave, and is set to LOW level when the drive waveform signal WCOM is lower than the triangular wave, is output. It should be noted that in the present embodiment, it is arranged that the carrier frequency of the modulated (PWM) signal can be adjusted by making the period of the triangular wave of the triangular wave oscillator 32 variable.

Figure 11:
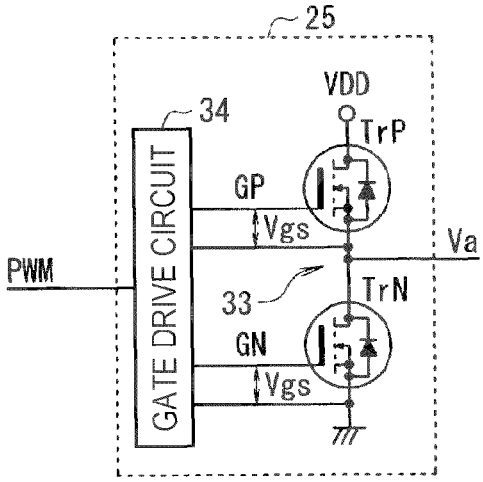
FIG. 11 is a block diagram of the digital power amplifier with only one stage of half-bridge driver stage.
Figure 12:
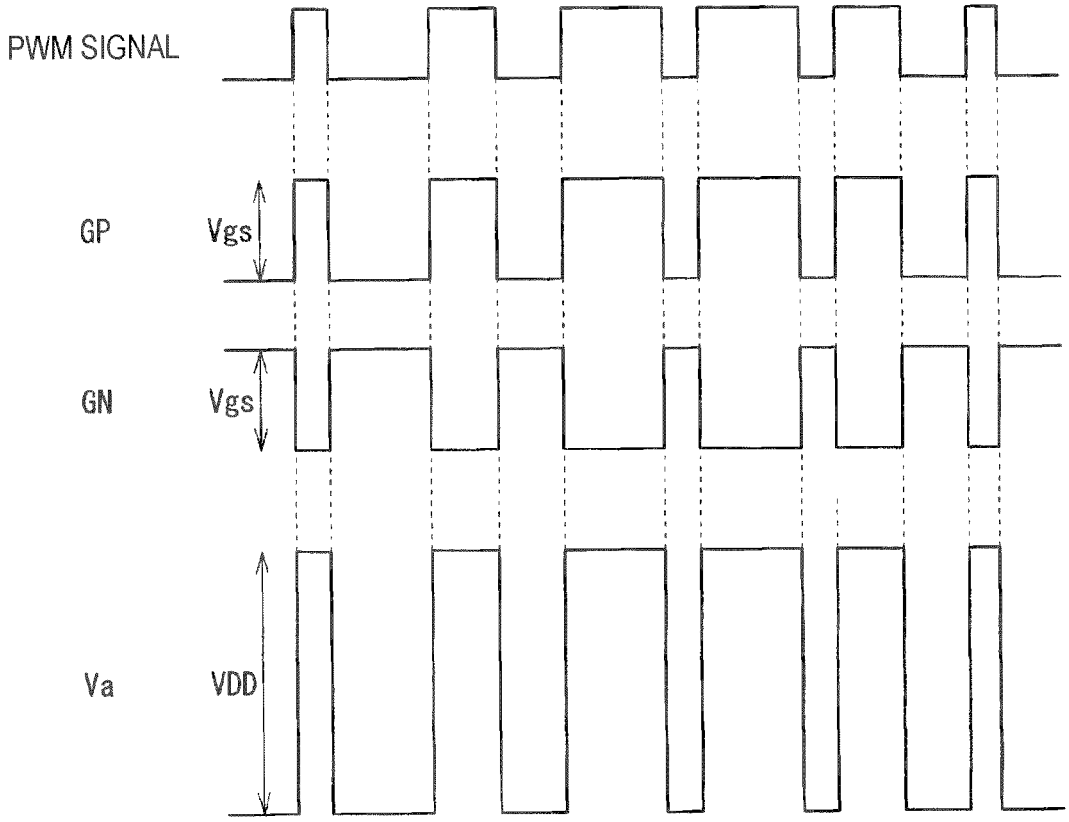
FIG. 12 is an explanatory diagram of the operation of the digital power amplifier shown in FIG. 11.

The operation of the digital power amplifier 25 will be explained using firstly the digital power amplifier 25 shown in FIG. 11, which is provided with only one stage of half-bridge driver stage 33 to the supply power VDD. The digital power amplifier 25 is configured including the half-bridge driver stage 33 composed of two MOSFET TrP, TrN for substantially amplifying the power, and a gate drive circuit 34 for controlling the gate-source signals GP, GN of the MOSFET TrP, TrN based on the modulated (PWM) signal from the modulator 24, and the half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 12 shows how these signals varies in accordance with the modulated (PWM) signal. It should be noted that the voltage values Vgs of the gate-source signals GP, GN of the respective MOSFET TrP, TrN are assumed to be sufficient to turn on the MOSFET TrP, TrN.

When the modulated (PWM) signal is in the HIGH level, the gate-source signal GP of the high-side MOSFET TrP becomes in the HIGH level while the gate-source signal GN of the low-side MOSFET TrN becomes in the LOW level, the high-side MOSFET TrP becomes the ON state while the low-side MOSFET TrN becomes the OFF state, and as a result, the output Va of the half-bridge driver state 33 becomes in the supply voltage VDD. On the other hand, when the modulated (PWM) signal is in the LOW level, the gate-source signal GP of the high-side MOSFET TrP becomes in the LOW level while the gate-source signal GN of the low-side MOSFET TrN becomes in the HIGH level, the high-side MOSFET TrP becomes the OFF state while the low-side MOSFET TrN becomes the ON state, and as a result, the output Va of the half-bridge driver state 33 becomes zero.

The output Va of the half-bridge driver stage 33 of the digital power amplifier 25 is supplied to the selection switch 201 as the drive signal COM via the low-pass filter 26. The low-pass filter 26 is composed of the combination of a resistor R, an inductance L, and a capacitance C. The low-pass filter 26 is designed to sufficiently attenuate the high frequency component of the output Va of the half-bridge driver stage 33 of the digital power amplifier 25, namely the power amplified modulated (PWM) signal component, and at the same time, not to attenuate the drive signal component COM (or alternatively, the drive waveform component WCOM).

As described above, when the MOSFET TrP, TrN of the digital power amplifier 25 are driven in a digital manner, since the MOSFET acts as a switch element, although the current flows in the MOSFET in the ON state, the drain-source resistance is extremely small, and the power loss is hardly caused. Further, since no current flows in the MOSFET in the OFF state, the power loss does not occur. Therefore, the power loss of the digital power amplifier 25 is extremely small, the small-sized MOSFET can be used, and the cooling unit such as a heat radiation plate for cooling can be eliminated. Incidentally, the efficiency in the case in which the transistor is driven in the linear range is about 30% while the efficiency of digital power amplifier is higher than 90%. Further, since the heat radiation plate for cooling the transistor requires about 60 mm square in size for each transistor, if such a radiation plate can be eliminated, an overwhelming advantage in the actual layout can be obtained.

Figure 13:
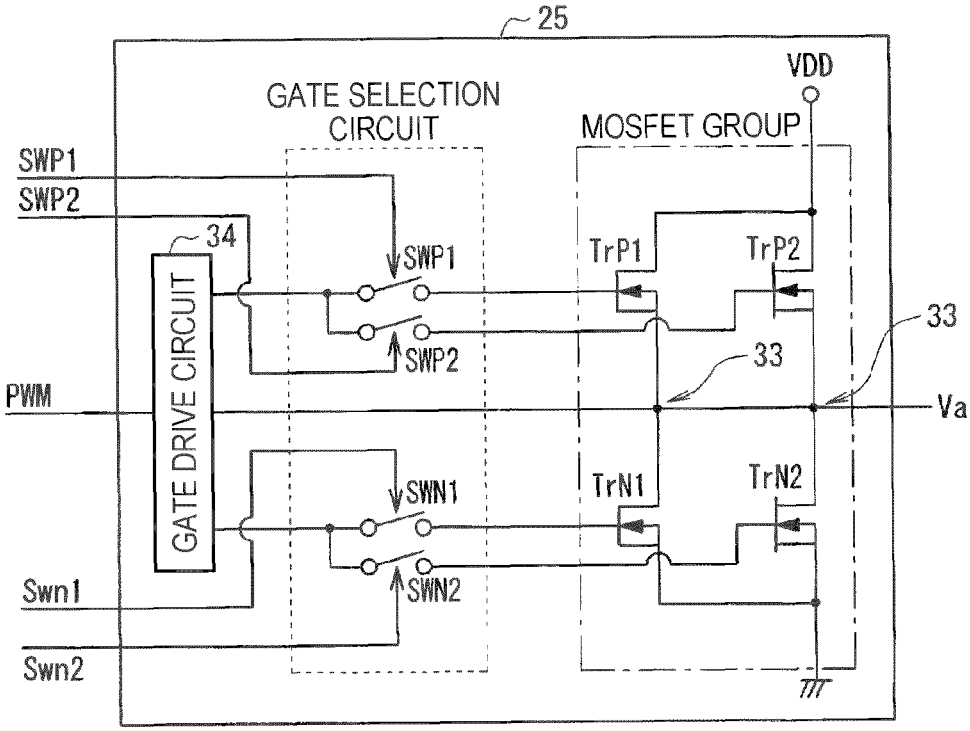
FIG. 13 is a block diagram showing details of the digital power amplifier shown in FIG. 9.

The basic operation of the digital power amplifier is as explained hereinabove. In addition, in the present embodiment, as shown in FIG. 13, the half-bridge driver stages 33 connected in parallel with each other are used with respect to the supply power VDD. The transistors are denoted, from the near side of the gate drive circuit 34, with a first high-side MOSFET TrP1, a first low-side MOSFET TrN1, a second high-side MOSFET TrP2, and a second low-side MOSFET TrN2. It should be noted that the transistors MOSFET TrP1, MOSFET TrN1, MOSFET TrP2, and MOSFET TrN2 are respectively provided with switches SWP1, SWN1, SWP2, and SWN2 for connecting/disconnecting the gate-source signals, which are opened and closed by the control section 62 described above with switch drive signals swp1, swn1, swp2, and swn2, respectively. Further, in the present embodiment, assuming that the gate capacitance of each of the first high-side MOSFET TrP1 and the first low-side MOSFET TrN1 is Qg, it is arranged that the gate capacitance of each of the second high-side MOSFET TrP2 and the second low-side MOSFET TrN2 becomes 2 Qg.

Figure 14:
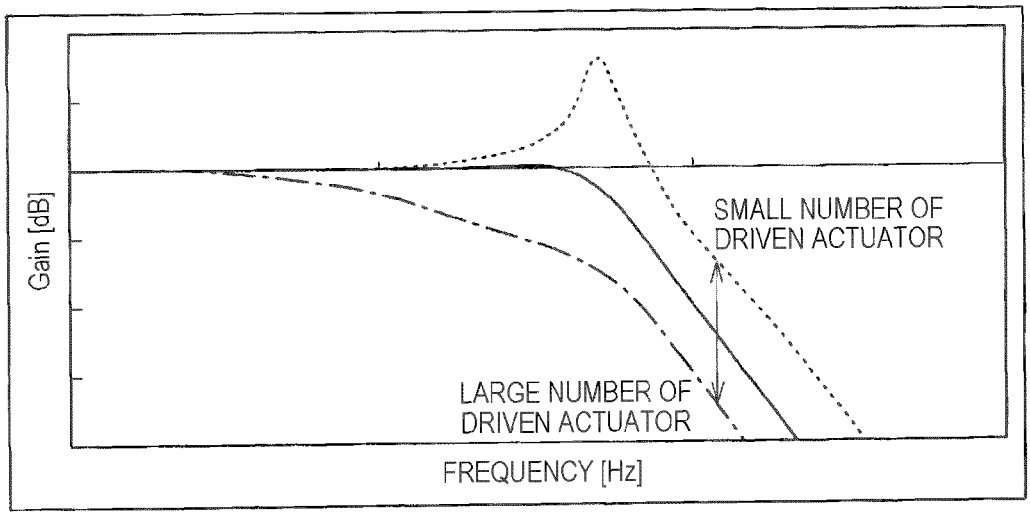
FIG. 14 is a frequency characteristic chart of the drive signal output circuit when the number of drive actuators is varied.
Figure 15A:
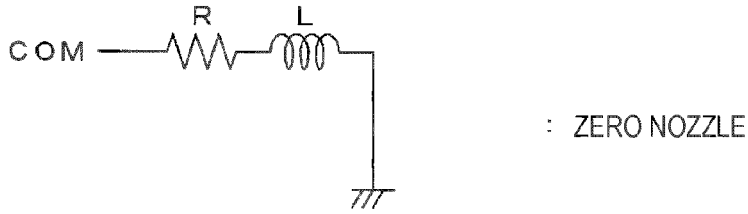
FIG. 15 shows explanatory diagrams of the low-pass filter formed by the actuators attached thereto.
Figure 15B:
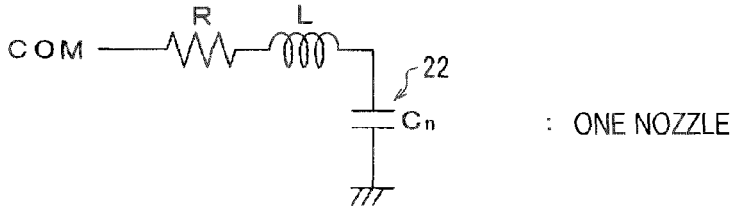
Figure 15C:
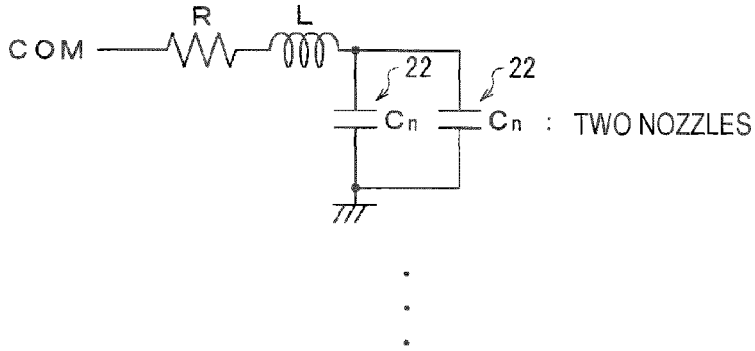
Figure 15D:
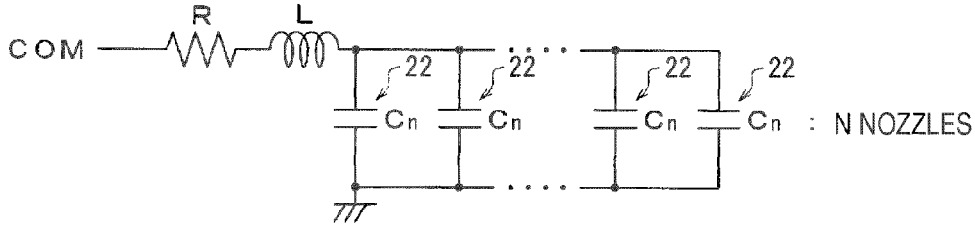

Hereinafter, the switch drive signals swp1, swn1, swp2, and swn2 output from the control section 62, and the period of the triangular wave in the modulator 24 will be explained. When the number (hereinafter also referred to as the number of driven actuators) of the actuators 22 connected thereto varies, the frequency characteristic is varied. According to the actual measurement of the frequency characteristic in the case in which the number of the driven actuators varies, as shown in FIG. 14, it appears that the larger the number of the driven actuators is, the more the gain is dropped, and the less the number of the driven actuators is, the more the gain is increased. This is because, the actuators 22 are connected in parallel to each other by the selection section. The actuators 22 such as the piezoelectric element each include a capacitance Cn. Every time the actuator 22 such as the piezoelectric element is connected, the capacitance Cn of the actuator 22 is connected in parallel one after another as shown in FIGS. 15B, 15C, and 15D in addition to the resistor R and the inductor L of the low-pass filter 26 shown in FIG. 15A, and the low-pass filter is problematically formed by the whole of the drive signal output circuit. If the drive signal output circuit forms the low-pass filter, the waveform of the drive pulse applied to the actuator 22 is naturally distorted.

Figure 16:
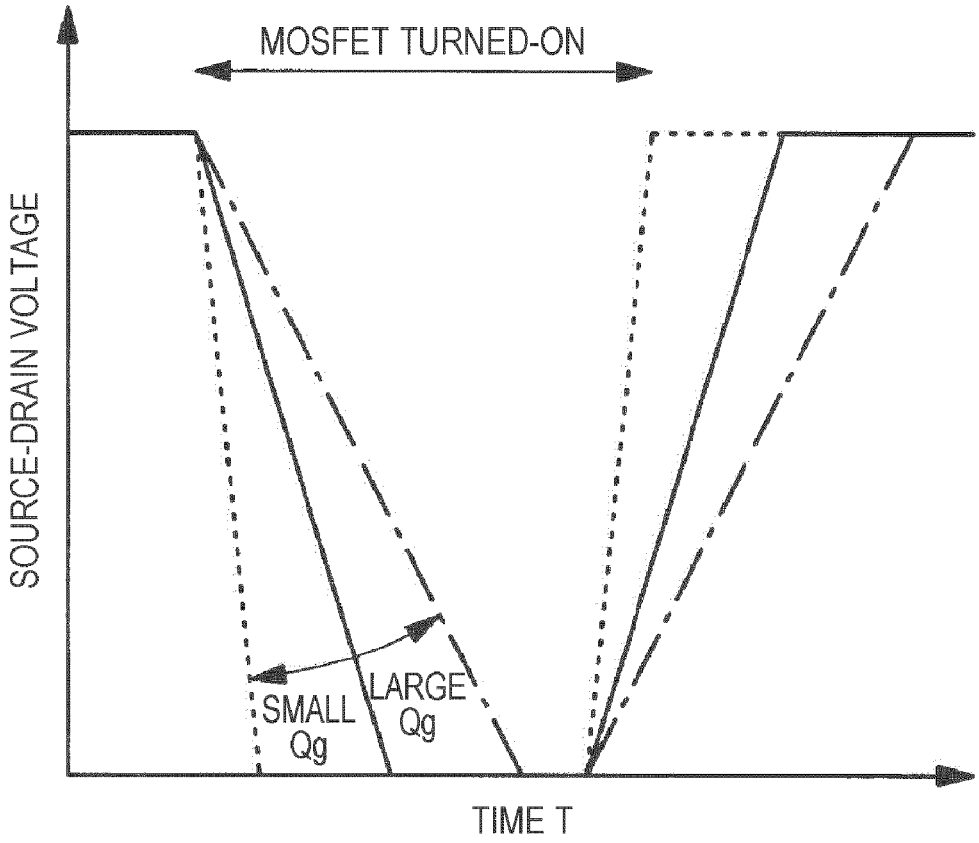
FIG. 16 is a characteristic diagram of the drain-source voltage when the gate capacitance of the MOSFET of the digital power amplifier is varied.
Figure 17A:
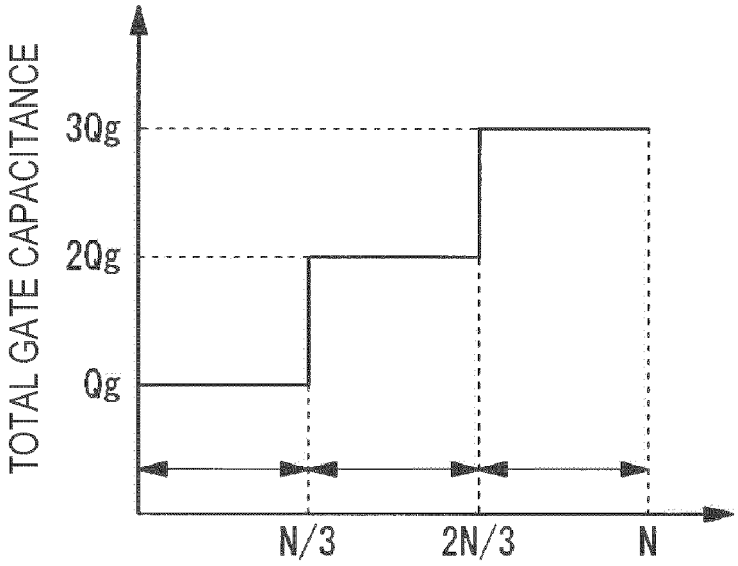
FIG. 17 is an explanatory diagram of the total gate capacitance and the apparent on-resistance achieved by the digital power amplifier shown in FIG. 13.
Figure 17B:
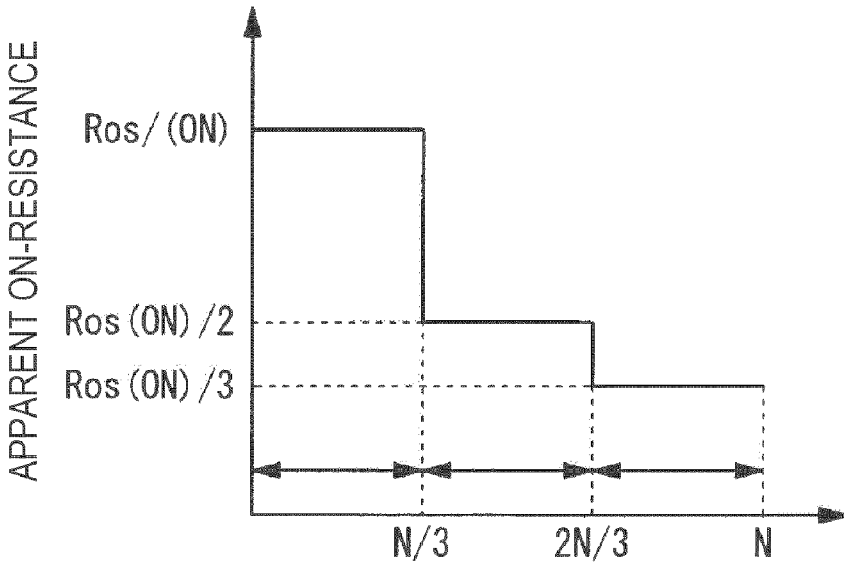

To summarize the specific problems, the waveform distortion of the drive pulse applied to the actuator 22 varies in accordance with the number of the driven actuators, thus the weight of the liquid jet emitted from the nozzle varies to cause degradation of the image quality. Further, the amount of attenuation in the carrier frequency band of the modulated (PWM) signal also varies. In particular, when the number of the driven actuators are small, the gain is increased, and the carrier frequency component remains in the generated waveform, namely the drive pulses, and the weight of the liquid jet emitted from the nozzle varies to cause degradation in the picture quality. In particular, in order for solving the latter problem, there is cited a method of raising the carrier frequency of the modulated (PWM) signal to reduce the remaining carrier frequency component in the drive pulse, namely so-called leakage of the carrier frequency component. In order for raising the carrier frequency, an element with a high switching speed, namely a MOSFET with a small gate capacitance is required in the digital power amplifier. However, since in the case in which the number of the driven actuators is large, the total capacitance of the actuators performing charge/discharge operations becomes also large, there is caused a necessity of flowing a large current between the drain and the source of the MOSFET. Although in this context, a MOSFET with a large chip size should be used to make the dynamic resistance, namely a so-called on-resistance RDS (ON) small, there is caused a trade-off that such a MOSFET with a large chip size causes a large gate capacitance Qg. The relationship between the gate capacitance Qg and the drain-source voltage is shown in FIG. 16. When the gate capacitance Qg becomes larger, the charge/discharge time naturally becomes longer, and accordingly, the switching speed is lowered and high-speed switching becomes more difficult. When the gate capacitance Qg is small, the switching speed becomes higher, and the high-speed switching becomes possible.

Therefore, in the present embodiment, the MOSFET connected in a push-pull manner, namely the half-bridge drivers 33 are connected in parallel to the supply power VDD in the digital power amplifier 25 while the gate capacitances of these MOSFET are set differently from each other, and the kinds and the number of the MOSFET used for the power amplification are adjusted in accordance with the number n of the driven actuators, thereby changing the gate capacitance or the on-resistance to satisfy both of high-speed switching and large current driving. Specifically, assuming that the total number of the actuators is N, if the number n of the driven actuators is equal to or smaller than N/3, the first high-side MOSFET TrP1 and the first low-side MOSFET TrN1 are driven, if the number n of the driven actuators is larger than N/3 and equal to or smaller than 2N/3, the second high-side MOSFET TrP2 and the second low-side MOSFET TrN2 are driven, and if the number n of the driven actuators is larger than 2N/3, the first high-side MOSFET TrP1, the first low-side MOSFET TrN1, the second high-side MOSFET TrP2, and the second low-side MOSFET TrN2 are driven. The total gate capacitance and the apparent on-resistance as the digital power amplifier 25 in this case becomes as shown in FIGS.

17A and 17B. Further, by adjusting the period of the triangular wave in accordance with the number n of the driven actuators, the carrier frequency of the modulated (PWM) signal is varied, thereby satisfying both of the reduction of the leakage of the carrier frequency component and the reduction of the switching loss.

Figure 18:
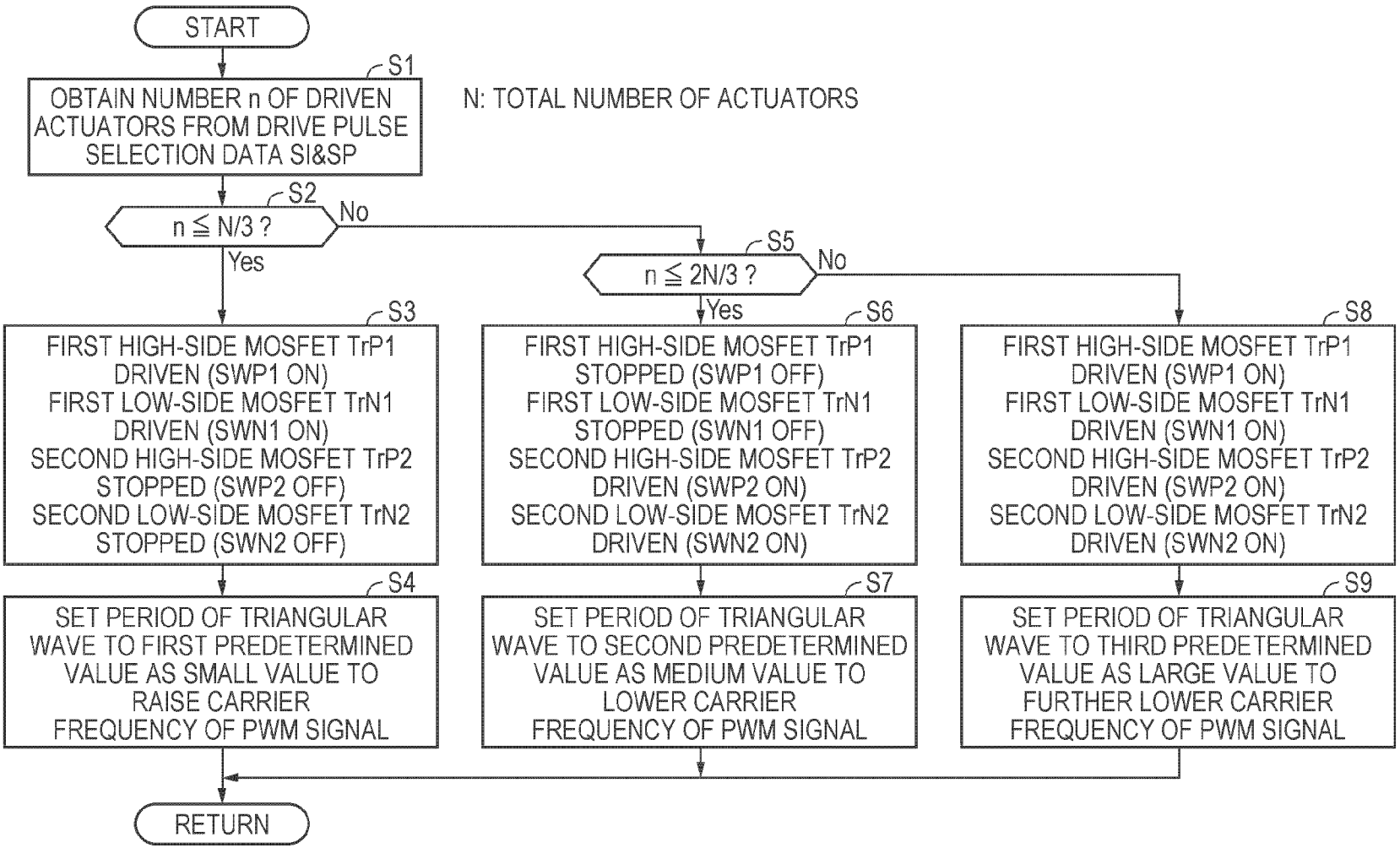
FIG. 18 is a flowchart showing the arithmetic processing for adjusting the kinds and the number of the MOSFET and the period of a triangular wave in accordance with the number of the actuators to be driven.

The arithmetic processing for switching the MOSFET and for switching the triangular wave period will be shown in the flowchart of FIG. 18. The arithmetic processing is performed every time the drive pulse selection data SI&SP corresponding to one line of the nozzle array is retrieved, and firstly in the step S1, the number n of the driven actuators is obtained from the drive pulse selection data SI&SP.

Subsequently, the process proceeds to the step S2 to judge whether or not the number n of the driven actuators thus obtained in the step S1 is equal to or smaller than a third of the total number N of the actuators, and if the number n of the driven actuators is equal to or smaller than N/3, the process proceeds to the step S3, otherwise the process proceeds to the step S5.

In the step S3, the first high-side MOSFET TrP1 and the first low-side MOSFET TrN1 are driven (the first high-side switch SWP1 and the first low-side switch SWN1 are turned on) the second high-side MOSFET TrP2 and the second low-side MOSFET TrN2 are stopped (the second high-side switch SWP2 and the second low-side switch SWN2 are turned off), and then the process proceeds to the step S4.

In the step S4, the period of the triangular wave is set to a first predetermined value as a smaller value to raise the carrier frequency of the modulated (PWM) signal, and then the process returns to the main program.

In the step S5, whether or not the number n of the driven actuators thus obtained in the step S1 is equal to or smaller than two thirds of the total number N of the actuators is judged, and if the number n of the driven actuators is equal to or smaller than 2N/3, the process proceeds to the step S6, otherwise the process proceeds to the step S8.

In the step S6, the first high-side MOSFET TrP1 and the first low-side MOSFET TrN1 are stopped (the first high-side switch SWP1 and the first low-side switch SWN1 are turned off) the second high-side MOSFET TrP2 and the second low-side MOSFET TrN2 are driven (the second high-side switch SWP2 and the second low-side switch SWN2 are turned on), and then the process proceeds to the step S7.

In the step S7, the period of the triangular wave is set to a second predetermined value as a medium value to lower the carrier frequency of the PWM signal, and then the process returns to the main program.

In the step S8, the first high-side MOSFET TrP1, the first low-side MOSFET TrN1, the second high-side MOSFET TrP2, and the second low-side MOSFET TrN2 are driven (the first high-side switch SWP1, the first low-side switch SWN1, the second high-side switch SWP2, and the second low-side switch SWN2 are turned on), and then the process proceeds to the step S9.

In the step S9, the period of the triangular wave is set to a third predetermined value as a large value to further lower the carrier frequency of the PWM signal, and then the process returns to the main program.

According to the present arithmetic processing, if the number of the driven actuators is small, the carrier frequency of the modulated (PWM) signal in the modulator 24 is raised and the total gate capacitance of the driven MOSFET becomes small, and accordingly, the high-speed switching of the MOSFET becomes possible, and the leakage of the carrier frequency component can be reduced by the high-speed switching of the MOSFET and the increase in the carrier frequency. Further, if the number of the driven actuators is large, the carrier frequency of the modulated (PWM) signal in the modulator 24 becomes lower, and the total gate capacitance of the MOSFET to be driven becomes large, in other words, the apparent on-resistance becomes smaller, and accordingly, the large current driving becomes possible, and the switching loss caused by lowering of the switching speed can also be reduced by the lowering of the carrier frequency.

As described above, according to the liquid jet apparatus and the printing apparatus of the present embodiment, the drive waveform signal WCOM, which is a base of a signal for controlling the operation of the actuator 22, is generated by the drive waveform generator 70, the generated drive waveform signal WCOM is pulse-modulated by the modulator 24, the pulse-modulated modulated signal is power-amplified by the digital power amplifier 25, and the power-amplified power amplified modulated signal is smoothed by the low-pass filter 26, and is supplied to the actuator 22 as the drive signal COM, by setting the filter characteristic of the low-pass filter 26 capable of sufficiently smoothing only the power amplified modulated signal component, thus the drive signal COM can efficiently be power-amplified by the digital power amplifier 25 with low power loss while achieving the rapid rising and falling of the drive signal COM to the actuator 22, the cooling unit such as the heat radiation plate for cooling can be eliminated.

Further, since it is arranged that the carrier frequency of the pulse modulation by the modulator 24 is adjusted in accordance with the number n of the actuators 22 to be driven, the reduction of the leakage of the carrier frequency component and the reduction of the switching loss in the drive signal output circuit become possible.

Since it is arranged that the carrier frequency of the pulse modulation is raised in the case in which the number n of the actuators 22 to be driven is small, and the carrier frequency of the pulse modulation is lowered in the case in which the number n of the actuators 22 to be driven is large, the leakage of the carrier frequency component when the number n of the actuators 22 to be driven is small is reduced, and the switching loss in the case in which the number n of the actuators 22 to be driven is large is reduced.

Further, since it is arranged that the number of the drive transistors (MOSFET) of the digital power amplifier 25 is adjusted in accordance with the number n of the actuators 22 to be driven, the high-speed switching and the large current driving become possible.

Further, since it is arranged that the number of the drive transistors (MOSFET) is lowered in the case in which the number n of the actuators 22 to be driven is small and the number of the drive transistors (MOSFET) is increased in the case in which the number n of the actuators 22 to be driven is large, the total capacitance of the transistors (MOSFET) in the case in which the number n of the actuators 22 to be driven is small is reduced to make the high-speed switching possible, and the drive current in the case in which the number n of the actuators 22 to be driven is large is distributed to a number of transistors (MOSFET) to make the large current driving possible.

It should be noted that although in the present embodiment, the example applying the present invention taking the line head printing apparatus as a target is only explained in detail, the liquid jet apparatus and the printing apparatus according to the present invention can also be applied to a multi-pass printing apparatus or any other types of printing apparatuses for printing letters or images on a print medium by emitting liquid jet as a target thereof. Further, each section configuring the liquid jet apparatus or the printing apparatus of the present invention can be replaced with an arbitrary configuration capable of exerting a similar function, or added with an arbitrary configuration.

Further, as a liquid emitted from the liquid jet apparatus of the present invention, there is no particular limitation, and liquids (including dispersion liquids such as suspensions or emulsions) containing various kinds of materials as mentioned below, for example. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on the surface of a substrate W, various coating materials, a liquid electrode material for forming the electrode, a particle material for forming a spacer for forming a microscopic cell gap between two substrates, a liquid metal material for forming metal wiring, a lens material for forming a microlens, a resist material, a light diffusion material for forming a light diffusion material, and so on can be cited.

Further, in the present invention, the print medium to be a target of the liquid jet emission is not limited to a piece of paper such as a recording sheet, but can be a film, a cloth, a nonwoven cloth, or other medium, or works such as various substrates such as a glass substrate, or a silicon substrate.

What is claimed is:

1. A liquid jet apparatus comprising:

a plurality of nozzles provided to a liquid jet head;

an actuator provided corresponding to each of the nozzles; and drive unit that applies a drive signal to the actuator, wherein the drive unit includes a drive waveform signal generation unit that generates a drive waveform signal providing a reference of a signal for controlling the operation of the actuator, a modulator unit that pulse-modulates the drive waveform signal generated by the drive waveform signal generation unit, and a digital power amplifier for power-amplifying the modulated signal, which is pulse-modulated by the modulator unit, a low-pass filter for smoothing the power-amplified and modulated signal power-amplified by the digital power amplifier and supplying the actuator with the power-amplified and modulated signal as the drive signal, and a feed-forward carrier frequency adjusting unit that adjusts a carrier frequency of the pulse modulation by the modulator unit based on printing data, the printing data indicative of the number of the actuators to be driven by the drive signal, the carrier frequency being adjusted before the drive signal is supplied to the actuator.

2. The liquid jet apparatus according to claim 1, wherein the carrier frequency adjusting unit raises the carrier frequency of the pulse modulation when the number of the actuators to be driven is small, and lowers the carrier frequency of the pulse modulation when the number of the actuators to be driven is large.

3. A printing apparatus comprising:

a plurality of nozzles provided to a liquid jet head;

an actuator provided corresponding to each of the nozzles; and drive unit that applies a drive signal to the actuator, wherein the drive unit includes a drive waveform signal generation unit that generates a drive waveform signal providing a basis of a signal for controlling the operation of the actuator, a modulator unit that pulse-modulates the drive waveform signal generated by the drive waveform signal generation unit, a digital power amplifier for power-amplifying the modulated signal, which is pulse-modulated by the modulator unit, a low-pass filter for smoothing the power-amplified and modulated signal power-amplified by the digital power amplifier and supplying the actuator with the power-amplified and modulated signal as the drive signal, and a feed-forward carrier frequency adjusting unit that adjusts a carrier frequency of the pulse modulation by the modulator unit based on printing data, the printing data indicative of the number of the actuators to be driven by the drive signal, the carrier frequency being adjusted before the drive signal is supplied to the actuator.

4. The printing apparatus according to claim 3 wherein the carrier frequency adjusting unit raises the carrier frequency of the pulse modulation when the number of the actuators to be driven is small, and lowers the carrier frequency of the pulse modulation when the number of the actuators to be driven is large.

* * * * *